US012173392B2

(12) United States Patent
Song et al.

(10) Patent No.: US 12,173,392 B2
(45) Date of Patent: Dec. 24, 2024

(54) AUSTENITIC STAINLESS STEEL HAVING INCREASED YIELD RATIO AND MANUFACTURING METHOD THEREOF

(71) Applicant: POSCO, Pohang-si (KR)

(72) Inventors: Seokweon Song, Pohang-si (KR); Hak Kim, Pohang-si (KR); Mi-nam Park, Pohang-si (KR)

(73) Assignee: POSCO, Pohang-si (KR)

( * ) Notice: Subject to any disclaimer, the term of this patent is extended or adjusted under 35 U.S.C. 154(b) by 407 days.

(21) Appl. No.: 17/772,324

(22) PCT Filed: Jul. 8, 2020

(86) PCT No.: PCT/KR2020/008950
§ 371 (c)(1),
(2) Date: Apr. 27, 2022

(87) PCT Pub. No.: WO2021/085800
PCT Pub. Date: May 6, 2021

(65) Prior Publication Data

US 2022/0403491 A1 Dec. 22, 2022

(30) Foreign Application Priority Data

Oct. 29, 2019 (KR) ..... 10-2019-0135211

(51) Int. Cl.
*C22C 38/58* (2006.01)
*C21D 8/02* (2006.01)
(Continued)

(52) U.S. Cl.
CPC ..... *C22C 38/58* (2013.01); *C21D 8/0226* (2013.01); *C21D 8/0236* (2013.01); *C21D 9/46* (2013.01);
(Continued)

(58) Field of Classification Search
CPC ..... C22C 38/58; C22C 38/02; C22C 38/42; C22C 38/001; C22C 38/38; C21D 8/0226;
(Continued)

(56) References Cited

U.S. PATENT DOCUMENTS 3,756,807 A 9/1973 Hoshino et al.
5,286,310 A 2/1994 Carinci et al.
(Continued)

FOREIGN PATENT DOCUMENTS

CN 104105805 A 10/2014
CN 109112430 A 1/2019
(Continued)

OTHER PUBLICATIONS

International Search Report dated Jan. 29, 2021 issued in International Patent Application No. PCT/KR2020/008950 (with English translation).
(Continued)

*Primary Examiner* — Adil A. Siddiqui
(74) *Attorney, Agent, or Firm* — Morgan, Lewis & Bockius LLP

(57) ABSTRACT

Disclosed is an austenitic stainless steel having an increased yield ratio. The disclosed austenitic stainless steel is characterized by comprising, in percent by weight (wt %), 0.1% or less (exclusive of 0) of C, 0.2% or less (exclusive of 0) of N, 1.5 to 2.5% of Si, 6.0 to 10.0% of Mn, 15.0 to 17.0% of Cr, 0.3% or less (exclusive of 0) of Ni, 2.0 to 3.0% of Cu, and the remainder of Fe and other inevitable impurities, and satisfying Expressions (1) and (2) below.

$$3.2 \le 5.53+1.4Ni-0.16Cr+17.1(C+N)+0.722Mn+1.4Cu-5.59Si \le 7 \quad \text{Expression (1):}$$

$$551-462(C+N)-9.2Si-8.1Mn-13.7Cr-29(Ni+Cu) \le 110 \quad \text{Expression (2):}$$

(Continued)

wherein C, N, Si, Mn, Cr, Ni, and Cu indicate the content (wt %) of respective elements.

10 Claims, 1 Drawing Sheet

(51) Int. Cl.
*C21D 9/46* (2006.01)
*C22C 38/02* (2006.01)
*C22C 38/42* (2006.01)

(52) U.S. Cl.
CPC ..... *C22C 38/02* (2013.01); *C22C 38/42* (2013.01); *C21D 2211/001* (2013.01)

(58) Field of Classification Search
CPC .. C21D 8/0236; C21D 9/46; C21D 2211/001; C21D 6/004; C21D 6/005; C21D 8/0205; C21D 8/0273
See application file for complete search history.

(56) References Cited

U.S. PATENT DOCUMENTS

| | | | |
|---|---|---|---|
| 2013/0039802 | A1 | 2/2013 | Talonen et al. |
| 2017/0268076 | A1 | 9/2017 | Talonen |
| 2020/0080178 | A1 | 3/2020 | Choi et al. |

FOREIGN PATENT DOCUMENTS

| | | | |
|---|---|---|---|
| CN | 110062814 | A | 7/2019 |
| EP | 2 799 569 | A1 | 11/2014 |
| EP | 3556892 | A1 | 10/2019 |
| GB | 1323919 | A | 7/1973 |
| GB | 2 138 024 | A | 10/1984 |
| JP | 50-5968 | B1 | 3/1975 |
| JP | 50-5971 | B1 | 3/1975 |
| JP | 61-124556 | A | 6/1986 |
| JP | 6-179946 | A | 6/1994 |
| JP | H10-36946 | A | 2/1998 |
| JP | 2008-038191 | A | 2/2008 |
| JP | 2015-508453 | A | 3/2015 |
| JP | 2015-206118 | A | 11/2015 |
| KR | 10-2003-0050211 | A | 6/2003 |
| KR | 10-2006-0075725 | A | 7/2006 |
| KR | 10-2014-0103297 | A | 8/2014 |
| KR | 10-2017-0029631 | A | 3/2017 |
| KR | 10-2018-0018908 | A | 2/2018 |
| KR | 10-2021-0157976 | A | 12/2021 |
| WO | 2019/112142 | A1 | 6/2019 |

OTHER PUBLICATIONS

Korean Notice of Allowance dated Apr. 27, 2021 issued in Korean Patent Application No. 10-2019-0135211.

Korean Office Action dated Jan. 25, 2021 issued in Korean Patent Application No. 10-2019-0135211.

Japanese Office Action dated Oct. 17, 2023 issued in Japanese Patent Application No. 2022-525254 (with English translation).

Extended European Search Report dated Jul. 22, 2022 issued in European Patent Application No. 20882286.6.

Chinese Office Action dated Jan. 30, 2023, issued in corresponding Chinese Patent Application No. 202080081452.0.

Office Action issued May 9, 2023 for counterpart Japanese Patent Application No. 2022-525254 (See English Translation).

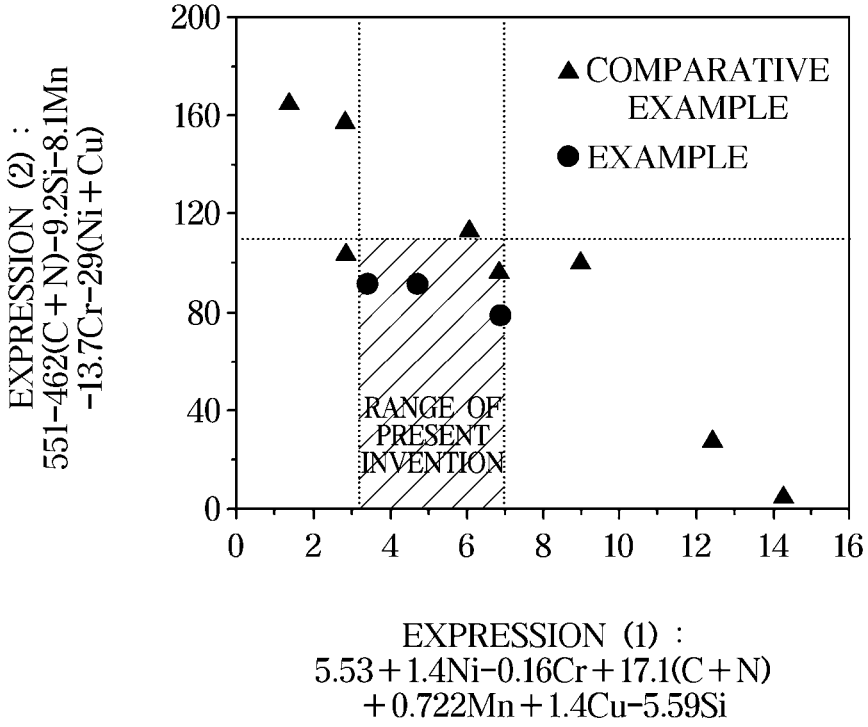
200
160
120
80
40
0
0
2
4
6
8
10
12
14
16
COMPARATIVE EXAMPLE
EXAMPLE
RANGE OF PRESENT INVENTION
EXPRESSION (2) :
551−462(C+N)−9.2Si−8.1Mn
−13.7Cr−29(Ni+Cu)
EXPRESSION (1) :
5.53+1.4Ni−0.16Cr+17.1(C+N)
+0.722Mn+1.4Cu−5.59Si

AUSTENITIC STAINLESS STEEL HAVING INCREASED YIELD RATIO AND MANUFACTURING METHOD THEREOF

CROSS-REFERENCE OF RELATED APPLICATIONS

This application is the U.S. National Phase under 35 U.S.C. § 371 of International Patent Application No. PCT/KR2020/008950, filed on Jul. 8, 2020, which in turn claims the benefit of Korean Application No. 10-2019-0135211, filed on Oct. 29, 2019, the entire disclosures of which applications are incorporated by reference herein.

TECHNICAL FIELD

The present disclosure relates to an austenitic stainless steel, and more particularly, to an austenitic stainless steel having an increased yield ratio even when a final annealing is performed under the temperature conditions of 1,050° C. or higher.

BACKGROUND ART

In accordance with environmental regulations in recent years, there have been demands not only for light-weight and high strength of structural steel materials suitable for structural members such as automobiles and railways to increase energy efficiency but also for enhancement of stability, collision characteristics, and durability of the structural members to meet requirements for safety regulations for passengers. Accordingly, production of structural materials has been changed from mass production of limited items in the past into small quantity production of diverse items according to demands of consumers and current trends.

Stainless steel is a material suitable for small quantity production of diverse items because stainless steel may be used as an alternative in terms of environmental regulation and energy efficiency issues by obtaining strength and formability thereof, and also separate investment for additional facilities to improve corrosion resistance is not required. Due to high elongation, austenitic stainless steels may be formed in complex shapes without causing problems and austenitic stainless steels may be applied to the fields that require molding due to fine appearance thereof.

However, there is a problem that austenitic stainless steels have lower yield strengths and yield ratios compared to common carbon steels for structures. In addition, austenitic stainless steels have relatively low yield ratios because yield strengths are low and tensile strengths are high due to martensite transformation.

The low yield ratio may deteriorate collision characteristics and durability of structural stainless steels, may decrease lifespan of molds during manufacturing processes, and may cause plastic non-uniformity. Therefore, there is a need to develop stainless steels having a high yield strength and a high yield ratio equivalent to those of carbon steels.

Meanwhile, alloying elements constituting austenitic stainless steels are expensive compared to those of common structural carbon steels. Particularly, the high price of Ni contained in austenitic stainless steels may cause a problem in terms of price competitiveness and limit use of austenitic stainless steels in structural members such as automobiles due to unstable supply and demand of raw materials and unstable supply prices thereof due to a wide fluctuation in prices of the materials.

Therefore, there is a need to develop austenitic stainless steels applicable to structural members such as automobiles by increasing the yield ratio while obtaining yield strength and elongation and reducing the content of the expensive elements Ni.

DISCLOSURE

Technical Problem

Provided is an austenitic stainless steel having an increased yield ratio together with yield strength and elongation.

Technical Solution

In accordance with an aspect of the present disclosure, an austenitic stainless steel having an increased yield ratio includes, in percent by weight (wt %), 0.1% or less (exclusive of 0) of C, 0.2% or less (exclusive of 0) of N, 1.5 to 2.5% of Si, 6.0 to 10.0% of Mn, 15.0 to 17.0% of Cr, 0.3% or less (exclusive of 0) of Ni, 2.0 to 3.0% of Cu, and the remainder of Fe and other inevitable impurities, and satisfies Expressions (1) and (2) below.

$$3.2 \leq 5.53+1.4Ni-0.16Cr+17.1(C+N)+0.722Mn+1.4Cu-5.59Si \leq 7 \quad \text{Expression (1):}$$

$$551-462(C+N)-9.2Si-8.1Mn-13.7Cr-29(Ni+Cu) \leq 110 \quad \text{Expression (2):}$$

Here, C, N, Si, Mn, Cr, Ni, and Cu indicate the content (wt %) of respective elements.

In addition, according to an embodiment of the present disclosure, the austenitic stainless steel may satisfy Expression (3) below.

$$[4.4+23(C+N)+1.3Si+0.24(Cr+Ni+Cu)+0.1*Mn]+0.16*[((Cr+1.5Si+18)/(Ni+0.52Cu+30(C+N)+0.5Mn+36)+0.262)*161-161] \geq 17 \quad \text{Expression (3):}$$

Here, C, N, Si, Mn, Cr, Ni, and Cu indicate the content (wt %) of respective elements.

In addition, according to an embodiment of the present disclosure, the yield ratio may be 0.6 or more.

In addition, according to an embodiment of the present disclosure, a yield strength may be 600 MPa or more.

In addition, according to an embodiment of the present disclosure, an elongation may be 35% or more.

In accordance with another aspect of the present disclosure, a method for manufacturing an austenitic stainless steel having an increased yield ratio includes: preparing a slab including, in percent by weight (wt %), 0.1% or less (exclusive of 0) of C, 0.2% or less (exclusive of 0) of N, 1.5 to 2.5% of Si, 6.0 to 10.0% of Mn, 15.0 to 17.0% of Cr, 0.3% or less (exclusive of 0) of Ni, 2.0 to 3.0% of Cu, and the remainder of Fe and other inevitable impurities, and satisfying Expressions (1) and (2) below; hot rolling the slab, hot annealing a hot-rolled steel sheet; cold rolling the hot-rolled, annealed steel sheet; and cold annealing the cold-rolled steel sheet at a temperature of 1,050° C. or higher.

$$3.2 \leq 5.53+1.4Ni-0.16Cr+17.1(C+N)+0.722Mn+1.4Cu-5.59Si \leq 7 \quad \text{Expression (1):}$$

$$551-462(C+N)-9.2Si-8.1Mn-13.7Cr-29(Ni+Cu) \leq 110 \quad \text{Expression (2):}$$

Here, C, N, Si, Mn, Cr, Ni, and Cu indicate the content (wt %) of respective elements.

In addition, according to an embodiment of the present disclosure, the slab may satisfy Expression (3) below.

$$[4.4+23(C+N)+1.3Si+0.24(Cr+Ni+Cu)+0.1*Mn]+0.16*[((Cr+1.5Si+18)/(Ni+0.52Cu+30(C+N)+0.5Mn+36)+0.262)*161-161]\geq 17 \quad \text{Expression (3):}$$

Here, C, N, Si, Mn, Cr, Ni, and Cu indicate the content (wt %) of respective elements.

In addition, according to an embodiment of the present disclosure, the cold annealing may be performed for 10 seconds to 10 minutes.

In addition, according to an embodiment of the present disclosure, the hot rolling may be performed at a temperature of 1,100 to 1,300° C.

In addition, according to an embodiment of the present disclosure, the hot annealing may be performed at a temperature of 1,000 to 1,100° C. for 10 seconds to 10 minutes.

Advantageous Effects

According to embodiments of the present disclosure, an austenitic stainless steel having an increased yield ratio while obtaining elongation and yield strength may be provided with a low cost.

DESCRIPTION OF DRAWINGS

FIG. 1 is a graph for describing the relationship between the values of Expressions (1) and (2).

BEST MODE

An austenitic stainless steel having an increased yield ratio according to an embodiment of the present disclosure includes, in percent by weight (wt %), 0.1% or less (exclusive of 0) of C, 0.2% or less (exclusive of 0) of N, 1.5 to 2.5% of Si, 6.0 to 10.0% of Mn, 15.0 to 17.0% of Cr, 0.3% or less (exclusive of 0) of Ni, 2.0 to 3.0% of Cu, and the remainder of Fe and other inevitable impurities, and satisfies Expressions (1) and (2) below:

$$3.2\leq 5.53+1.4Ni-0.16Cr+17.1(C+N)+0.722Mn+1.4Cu-5.59Si\leq 7 \quad \text{Expression (1):}$$

$$551-462(C+N)-9.2Si-8.1Mn-13.7Cr-29(Ni+Cu)\leq 110 \quad \text{Expression (2):}$$

wherein C, N, Si, Mn, Cr, Ni, and Cu indicate the content (wt %) of respective elements.

MODES OF THE INVENTION

Hereinafter, embodiments of the present disclosure will be described in detail with reference to the accompanying drawings. The following embodiments are provided to fully convey the spirit of the present disclosure to a person having ordinary skill in the art to which the present disclosure belongs. The present disclosure is not limited to the embodiments shown herein but may be embodied in other forms. In the drawings, parts unrelated to the descriptions are omitted for clear description of the disclosure and sizes of elements may be exaggerated for clarity.

Throughout the specification, the term "include" an element does not preclude other elements but may further include another element, unless otherwise stated.

As used herein, the singular forms are intended to include the plural forms as well, unless the context clearly indicates otherwise.

Hereinafter, embodiments of the present disclosure will be described in detail with reference to the accompanying drawings.

An austenitic stainless steel having an increased yield ratio according to an embodiment of the present disclosure includes, in percent by weight (wt %), 0.1% or less (exclusive of 0) of carbon (C), 0.2% or less (exclusive of 0) of nitrogen (N), 1.5 to 2.5% of silicon (Si), 6.0 to 10.0% of manganese (Mn), 15.0 to 17.0% of chromium (Cr), 0.3% or less (exclusive of 0) of nickel (Ni), 2.0 to 3.0% of copper (Cu), and the remainder of iron (Fe) and other inevitable impurities.

Hereinafter, reasons for numerical limitations on the contents of alloying elements in the embodiment of the present disclosure will be described. Hereinafter, the unit is wt % unless otherwise stated.

The content of C is 0.1% or less (exclusive of 0).

Carbon (C), as an element effective on stabilizing an austenite phase, is added to obtain a yield strength of an austenitic stainless steel. However, an excess of C may not only deteriorate cold workability due to solid strengthening effect but also adversely affect ductility, toughness, corrosion resistance, and the like by inducing grain boundary precipitation of a Cr carbide. Therefore, an upper limit thereof may be set to 0.1%.

The content of N is 0.2% or less (exclusive of 0).

Nitrogen (N) is a strong austenite-stabilizing element effective on enhancing corrosion resistance and yield strength of an austenitic stainless steel. However, an excess of N may deteriorate cold workability due to solid solution strengthening effect. Therefore, an upper limit thereof may be set to 0.2%.

The content of Si is from 1.5 to 2.5%.

Silicon (Si), serving as a deoxidizer during a steelmaking process, is effective on enhancing corrosion resistance and may be added in an amount of 1.5% or more. However, because Si is also an element effective on stabilizing a ferrite phase, an excess of Si may promote formation of delta (δ) ferrite in a cast slab, thereby not only deteriorating hot workability but also deteriorating ductility and toughness of a steel material due to solid solution strengthening effect. Therefore, an upper limit thereof may be set to 2.5%.

The content of Mn is from 6.0 to 10.0%.

Manganese (Mn), as an element stabilizing an austenite phase added as a Ni substitute, may be added in an amount of 6.0% or more to enhance cold rollability by inhibiting formation of strain-induced martensite. However, an excess of Mn may cause an increase in formation of S-based inclusions (MnS) resulting in deterioration of ductility, toughness, and corrosion resistance of austenitic stainless steels and may also cause formation of Mn fumes during a steelmaking process resulting in increased manufacturing risks. Therefore, an upper limit thereof may be set to 10.0%.

The content of Cr is from 15.0 to 17.0%.

Chromium (Cr) is an element stabilizing a ferrite phase but effective on suppressing formation of a martensite phase. As a basic element for obtaining corrosion resistance required in stainless steels, Cr may be added in an amount of 15% or more. However, an excess of Cr may increase manufacturing costs and promote formation of delta (δ) ferrite in a slab resulting in deterioration of hot workability. Therefore, an upper limit thereof may be set to 17.0%.

The content of Ni is 0.3% or less (exclusive of 0).

Nickel (Ni), as a strong austenite phase-stabilizing element, is essential to obtain excellent hot workability and cold workability. However, because Ni is an expensive element, costs of raw materials may increase in the case of adding a large amount of Ni. Therefore, an upper limit thereof may be set to 0.3% in consideration of both costs and efficiency of steel materials.

The content of Cu is from 2.0 to 3.0%.

Copper (Cu), as an austenite phase-stabilizing element added instead of nickel (Ni) in the present disclosure, is added in an amount of 2.0% or more to enhance corrosion resistance under a reducing environment. However, an excess of Cu not only increases costs of raw materials but also causes liquefaction and embrittlement at a low temperature. Thus, an upper limit thereof may be set to 3.0% in consideration of costs-efficiency and properties of steel materials.

In addition, the austenitic stainless steel having improved strength according to an embodiment of the present disclosure may further include at least one of 0.035% or less of phosphorus (P) and 0.01% or less of sulfur (S).

The content of P is 0.035% or less.

Phosphorus (P), as an impurity that is inevitably contained in steels, is a major element causing grain boundary corrosion or deterioration of hot workability, and therefore, it is preferable to control the P content as low as possible. In the present disclosure, an upper limit of the P content is controlled to 0.035%.

The content of S is 0.01% or less.

Sulfur (S), as an impurity that is inevitably contained in steels, is a major element causing deterioration of hot workability as being segregated in grain boundaries, and therefore, it is preferable to control the S content as low as possible. In the present disclosure, an upper limit of the S content is controlled to 0.01%.

The remaining component of the composition of the present disclosure is iron (Fe). However, the composition may include unintended impurities inevitably incorporated from raw materials or surrounding environments. In the present disclosure, addition of other unintended alloying elements in addition to the above-described alloying elements is not excluded. The impurities are not specifically mentioned in the present disclosure, as they are known to any person skilled in the art.

In recent years, as well as light-weight of structural steel materials, stability thereof has been considered as a major issue. Accordingly, steel materials used for automotive members and various structural members and used in an environment to which a load is applied require high yield ratios in addition to excellent strength.

The yield ratio is a value obtained by dividing a yield strength by a tensile strength as a value indicating physical properties considered as an important factor in structural steel materials in terms of manufacture and use. Austenitic stainless steels generally have very low yield ratios. Due to low yield ratios, use of austenitic stainless steels is limited as structural members because shapes of parts should be changed.

In structural members, the yield strength is a main physical property required to actually support a load. When a load exceeds a yield strength of a structural member, problems such as distortion of the structural member may occur leading to non-uniform stress resulting in destruction of the structural member. That is, a high yield strength is an essential factor of a material used for a structural member to obtain stability of the structural member and high reliability for a user.

However, as the tensile strength increases, a large amount of energy should be used to deform a material, thereby causing a decrease in lifespan of a manufacturing apparatus. Therefore, it is important to increase the yield ratio in consideration of stable load support and industrial aspects.

In addition, in order to obtain price competitiveness of austenitic stainless steels, amounts of expensive austenite-stabilizing elements such as Ni should be reduced and amounts of Mn, N, and Cu added to compensate therefor need to be expected.

However, in the case where the Ni content is reduced and other elements such as Mn, N, and Cu are added to obtain price competitiveness, a problem of rapid occurrence of work hardening may be caused to decrease the yield ratio. As the yield ratio of the austenitic stainless steel decreases, the strength rapidly increases due to deformation during a manufacturing process, thereby causing problems of decreases in lifespan of molding tools and molds.

To solve these problems, Expression (1) below was derived in the present disclosure in order to increase a yield ratio of an austenitic stainless steel by controlling a deformation behavior by adding Si and N and adjusting a composition ratio among Mn, Ni, and N.

$$5.53+1.4Ni-0.16Cr+17.1(C+N)+0.722Mn+1.4Cu-5.59Si \quad \text{Expression (1):}$$

Here, C, N, Si, Mn, Cr, Ni, and Cu indicate the content (wt %) of respective elements.

A value represented by Expression (1) above satisfies a range equal to or more than 3.2 to equal to or less than 7 in the austenitic stainless steel having an increased yield ratio according to an embodiment of the present disclosure.

The present inventors have found that expression of cross slip of an austenite phase by an external stress becomes difficult as the value of Expression (1) decreases. Specifically, when the value of Expression (1) is less than 3.2, an austenitic stainless steel exhibits only a planar slip behavior with respect to deformation and dislocation pile-up by external stress proceeds to exhibit plastic non-uniformity and high work hardening. As a result, the elongation and the yield ratio of an austenitic stainless steel decrease, and thus a lower limit of the value of Expression (1) is set to 3.2.

On the contrary, when the value of Expression (1) is too high, cross slip frequently occurs, thereby increasing plastic non-uniformity in which a stress is concentrated to a weak part of a steel material. As strength of a steel material increases, effects of such embrittlement and plastic non-uniformity increase failing to obtain an elongation of the steel material, and therefore an upper limit of Expression (1) is set to 7.

In addition, in consideration of phase transformation occurring due to deformation of an austenitic stainless steel, Expression (2) below was derived in the present disclosure.

$$551-462(C+N)-9.2Si-8.1Mn-13.7Cr-29(Ni+Cu) \quad \text{Expression (2):}$$

Here, C, N, Si, Mn, Cr, Ni, and Cu indicate the content (wt %) of respective elements.

A value represented by Expression (2) above satisfies a range equal to or less than 110 in the austenitic stainless steel having an increased yield ratio according to an embodiment of the present disclosure.

The present inventors have found that an austenite phase is more easily transformed into martensite by an external stress as the value of Expression (2) increases. Specifically, when the value of Expression (2) exceeds 110, an austenitic stainless steel exhibited a rapid deformation-induced martensitic transformation behavior by external deformation and plastic non-uniformity occurred. As a result, elongation and yield ratio of the austenitic stainless steel decrease, and therefore, an upper limit of the value of Expression (2) is set to 110.

In addition, in the present disclosure, Expression (3-1) below was derived in consideration of effects of a stress field on a yield strength of a steel material in order to obtain a yield strength of an austenitic stainless steel, and Expression (3-2) indicating a residual amount of ferrite in the austenitic stainless steel was derived as follows.

$$4.4+23(C+N)+1.3Si+0.24(Cr+Ni+Cu)+0.1*Mn \quad \text{Expression (3-1):}$$

$$((Cr+1.5Si+18)/(Ni+0.52Cu+30(C+N)+0.5Mn+36)+0.262)*161-161 \quad \text{Expression (4-1):}$$

Here, C, N, Si, Mn, Cr, Ni, and Cu indicate the content (wt %) of respective elements.

As the value of Expression (3-1) increases, the stress field between lattices increases due to a difference in atomic size between elements in an alloy and thus tolerance to plastic deformation against an external stress increases.

Expression (3-2) exhibits stability of a ferrite phase at a high temperature. As the value of Expression (3-2) increases, an amount of ferrite generated at a high temperature increases, and accordingly a fraction of ferrite remaining at room temperature increase. Therefore, the yield strength of the austenitic stainless steel may be increased.

In the present disclosure, in order to obtain a yield strength of the austenitic stainless steel, Expression (3) below was derived by simultaneously considering effects of the stress field on the yield strength and ferrite fraction and establishing the relevance between Expression (3-1) and Expression (3-2).

$$[4.4+23(C+N)+1.3Si+0.24(Cr+Ni+Cu)+0.1*Mn]+0.16*[((Cr+1.5Si+18)/(Ni+0.52Cu+30(C+N)+0.5Mn+36)+0.262)*161-161] \quad \text{Expression (5):}$$

Here, C, N, Si, Mn, Cr, Ni, and Cu indicate the content (wt %) of respective elements.

In Expression (3), the value 0.16 is a weight obtained in consideration of a case in which the effects of the stress field on the yield strength are greater. The weight is a constant experimentally derived from commercially available materials and materials under development.

In the austenitic stainless steel having an increased yield ratio according to an embodiment of the present disclosure, a value obtained by Expression (3) satisfies a range equal to or more than 17. When the value of Expression (3) is less than, the yield strength of the austenitic stainless steel cannot be 600 MPa or more.

The austenitic stainless steel according to the present disclosure satisfying the composition ratio of the alloying elements and the relational expressions described above may have a yield ratio (yield strength/tensile strength) of 0.6 or more, a yield strength of 600 MPa or more, and an elongation of 35% or more.

As described above, the austenitic stainless steel may also have a high yield strength and a high yield ratio. Accordingly, not only formation and manufacture of structural members are easily performed using the austenitic stainless steel but also stability of the manufactured structural members and reliability for a user may be obtained.

Then, a method for manufacturing an austenitic stainless steel having improved strength according to another embodiment of the present disclosure will be described.

A method for manufacturing an austenitic stainless steel having an increased yield ratio according to another embodiment of the present disclosure may include: preparing a slab including, in percent by weight (wt %), 0.1% or less (exclusive of 0) of C, 0.2% or less (exclusive of 0) of N, 1.5 to 2.5% of Si, 6.0 to 10.0% of Mn, 15.0 to 17.0% of Cr, 0.3% or less (exclusive of 0) of Ni, 2.0 to 3.0% of Cu, and the remainder of Fe and other inevitable impurities, and satisfying Expressions (1) and (2) below; hot rolling the slab; hot annealing a hot-rolled steel sheet; cold rolling the hot-rolled, annealed steel sheet; and cold annealing the cold-rolled steel sheet at a temperature of 1,050° C. or higher.

The reasons for the numerical limitations on the contents of the alloying elements are as described above.

The stainless steel having the above-described composition is produced by preparing a slab by continuous casting or steel ingot casting and performing a series of hot rolling and hot annealing processes and then cold rolling and cold annealing processes.

Conventionally, as a method of enhancing the strength of austenitic stainless steels, skin pass rolling has been introduced. The skin pass rolling is a method of using high work hardening occurring as an austenite phase is transformed into strain-induced martensite during cold working or using dislocation pile-up of steel a material. However, elongation of the austenitic stainless steel to which the skin pass rolling is applied is rapidly decreased, making it difficult to perform a subsequent process, and surface defects may occur.

In addition, for easy skin pass rolling, an alloy composition that facilitates dislocation pile-up and phase transformation is commonly used. In this case, work hardening increases and yield ratio decreases, thereby causing a problem of plastic non-uniformity of a steel material.

Meanwhile, as a method for improving the yield strength austenitic stainless steels, a final cold annealing process has been conventionally performed at a low temperature of 1,000° C. or below. The low-temperature annealing is a method of using energy accumulated in a material during cold rolling without completing recrystallization. However, an austenitic stainless steel to which the low-temperature annealing is applied may have disadvantages of non-uniform distribution of elements, insufficient acid pickling effect during a subsequent acid pickling process, and poor surface shape.

In the present disclosure, as a method of removing such disadvantages of the skin pass rolling and low-temperature annealing, attempts have been made to obtain a yield ratio of an austenitic stainless steel by cold annealing at a high temperature of 1,050° C. or higher.

For example, the slab may be hot-rolled at a common rolling temperature of 1,100 to 1,300° C., and the hot-rolled steel sheet may be hot-annealed at a temperature of 1,000 to 1,100° C. In this case, the hot annealing may be performed for 10 seconds to 10 minutes.

Then, the hot-rolled, annealed steel sheet may be cold-rolled to prepare a thin plate.

In the present disclosure, cold annealing heat treatment is performed at a relatively high temperature of 1,050° C. or higher after the cold-rolling to obtain a yield strength of 600 MPa or more, a yield ratio of 0.6 or more, and an elongation of 35% or more.

The cold annealing may be performed at a temperature of 1,050° C. or higher. In addition, the cold annealing according to an embodiment of the present disclosure may be performed at a temperature of 1,050° C. or higher for 10 seconds to 10 minutes.

By adjusting the alloying elements and the relational expressions as described above, a final cold-rolled, annealed steel material may have a high yield strength and a high yield ratio via common cold rolling and cold annealing without performing additional skin pass rolling or low-temperature annealing, and thus price competitiveness may be obtained.

The austenitic stainless steel having an increased strength according to the present disclosure may be used, for example, in general products for formation, e.g., products such as slab, bloom, billet, coil, strip, plate, sheet, bar, rod, wire, shape steel, pipe, or tube.

Hereinafter, the present disclosure will be described in more detail with reference to the following examples.

Slabs having various composition ratios of alloying elements shown in Table 1 below were prepared by ingot melting, heated at 1,250° C. for 2 hours, and hot-rolled. After hot rolling, hot annealing was performed at 1,100° C. for 90 seconds. Then, cold rolling was performed with a reduction ratio of 70% and cold annealing was performed at 1,100° C.

Compositions (wt %) of alloying elements of respective experimental steel types and values of Expression (1), Expression (2), Expression (3-1), Expression (3-1), and Expression (3) are shown in Table 1 below.

TABLE 1

| | Elements (wt %) | | | | | | | Expression (1) | Expression (2) | Expression (3) | Expression (4) | Expression (5) |
|---|---|---|---|---|---|---|---|---|---|---|---|---|
| | C | Si | Mn | Ni | Cr | Cu | N | | | | | |
| Example 1 | 0.05 | 2.0 | 9.5 | 0.13 | 16.0 | 2.0 | 0.13 | 4.71 | 91.5 | 16.4 | 7.1 | 17.6 |
| Example 2 | 0.08 | 2.0 | 6.0 | 0.13 | 16.0 | 2.5 | 0.13 | 3.40 | 91.5 | 16.9 | 8.7 | 18.3 |
| Example 3 | 0.06 | 1.5 | 8.0 | 0.20 | 17.0 | 2.0 | 0.15 | 6.87 | 78.7 | 16.6 | 7.3 | 17.8 |
| Comparative Example 1 | 0.12 | 0.6 | 0.9 | 7.0 | 17.1 | 0.0 | 0.05 | 12.44 | 28.2 | 14.9 | 1.2 | 15.1 |
| Comparative Example 2 | 0.055 | 0.4 | 1.1 | 8.1 | 18.2 | 0.1 | 0.04 | 14.28 | 5.5 | 13.6 | 6.1 | 14.5 |
| Comparative Example 3 | 0.08 | 2.0 | 9.5 | 0.13 | 14.2 | 0.1 | 0.13 | 2.85 | 157.4 | 16.2 | 1.2 | 16.4 |
| Comparative Example 4 | 0.13 | 2.0 | 7.0 | 0.13 | 16.0 | 1.0 | 0.13 | 2.87 | 103.8 | 17.8 | 5.4 | 18.7 |
| Comparative Example 5 | 0.08 | 1.0 | 6.0 | 0.13 | 16.0 | 2.5 | 0.13 | 8.99 | 100.7 | 15.6 | 3.5 | 16.2 |
| Comparative Example 6 | 0.08 | 1.5 | 6.0 | 0.2 | 15.0 | 2.0 | 0.15 | 6.09 | 113.0 | 16.4 | 1.6 | 16.6 |
| Comparative Example 7 | 0.08 | 2.0 | 6.5 | 0.13 | 14.5 | 1.0 | 0.10 | 1.38 | 165.4 | 15.5 | 7.4 | 16.7 |
| Comparative Example 8 | 0.05 | 1.5 | 7.5 | 0.5 | 16.0 | 2.5 | 0.11 | 6.94 | 96.3 | 15.3 | 7.1 | 16.5 |

The cold-rolled steel materials having the above-descried compositions were cold-annealed at 1,100° C. for 10 seconds and then elongations, yield strengths, tensile strengths, and yield ratios of the cold-rolled, annealed materials were measured. Specifically, a tensile test was carried out at room temperature according to the ASTM standard method and the yield strengths (MPa), tensile strengths (MPa), elongations (%), and yield ratios measured thereby are shown in Table 2 below.

TABLE 2

| | Yield strength (MPa) | Tensile strength (MPa) | Elongation (%) | Yield ratio |
|---|---|---|---|---|
| Example 1 | 629.4 | 876.0 | 45.9 | 0.72 |
| Example 2 | 695.2 | 1157.4 | 36.3 | 0.60 |
| Example 3 | 612.6 | 983.8 | 50.3 | 0.62 |
| Comparative Example 1 | 329.3 | 754.4 | 54.7 | 0.43 |
| Comparative Example 2 | 294.2 | 667.4 | 53.2 | 0.44 |
| Comparative Example 3 | 397.0 | 1341.9 | 42.9 | 0.30 |
| Comparative Example 4 | 677.7 | 1449.0 | 39.3 | 0.47 |
| Comparative Example 5 | 561.6 | 1251.5 | 27.8 | 0.45 |
| Comparative Example 6 | 477.5 | 1276.9 | 36.1 | 0.37 |
| Comparative Example 7 | 422.4 | 1490.6 | 23.1 | 0.28 |

TABLE 2-continued

| | Yield strength (MPa) | Tensile strength (MPa) | Elongation (%) | Yield ratio |
|---|---|---|---|---|
| Comparative Example 8 | 475.0 | 854 | 54.8 | 0.56 |

FIG. 1 is a graph for describing the relationship between the values of Expressions (1) and (2) of the present disclosure. Referring to FIG. 1, the steel type of Comparative Example 8 was classified as a comparative example because the value of Expression (5) could not reach 17 although the ranges of Expressions (1) and (2) were satisfied.

Referring to Table 2, it was confirmed that in the cases of Examples 1 to 3, which satisfy the composition ratios of the alloying elements and the ranges of Expression (1), (2), and (5) suggested by the present disclosure, yield strengths of 600 MPa or more, yield ratios of 0.6 or more, and excellent elongations of 35% or more may be obtained. In addition, because the content of Ni, which is an expensive austenite-stabilizing element, may be reduced, price competitiveness of austenitic stainless steels may be obtained.

Comparative Examples 1 and 2 show commercially available standard austenitic stainless steels. Because the composition ratio of the alloying elements suggested by the present disclosure was not satisfied, particularly, more than 7% of Ni was added, price competitiveness cannot be obtained, and also the value of Expression (5) was less than 17, failing to obtain a desired yield strength of 600 MPa or more.

Comparative Example 3 did not satisfy the ranges of Expressions (1), (2), and (5) suggested by the present disclosure, and thus it was confirmed that low yield strengths and low yield ratios were obtained due to rapid work hardening.

Comparative Example 4 shows a case in which the value of Expression (1) was 2.87, which could not reach 3.2. Although rapid martensite transformation did not occur during deformation because the value of Expression (2) was less than 110 and a high yield strength was obtained because the value of Expression (3) was greater than 17. Dislocation pile-up caused by an external stress proceeded due to the low value of Expression (1), and accordingly the tensile strength rapidly increased failing to obtain a yield ratio of 0.6 or more.

Comparative Example 5 shows a case in which the value of Expression (1) was 8.99, which exceeds 7, and plastic non-uniformity significantly occurred and thus a very low elongation was obtained.

Comparative Examples 6 and 7 show cases in which the values of Expression (2) were 113.0 and 165.4, respectively, which exceed 110. Because rapid martensite phase transformation occurred by deformation, the tensile strength rapidly increased failing to obtain a yield ratio of 0.6 or more. Particularly, although Comparative Example 6 satisfied the composition ratio of the alloying elements suggested by the present disclosure and satisfied the ranges of Expressions (1) and (3), the tensile strength rapidly increased because the value of Expression (2) was not satisfied and thus the low yield ratio of 0.28 was obtained.

Because the steel type of Comparative Example 8 satisfied the composition ratio of the alloying elements suggested by the present disclosure and satisfied the ranges of Expressions (1) and (2), the yield ratio greater than 0.56 was obtained by controlling work hardening caused by deformation. However, the value of Expression (3) could not reach 17, and thus a yield strength of 600 MPa or more could not be obtained.

As described above, according to the disclosed embodiments, an austenitic stainless steel having a yield ratio of 0.6 or more, a yield strength of 600 MPa or more, and an elongation of 35% or more may be prepared by adjusting the alloying elements and the relational expressions therebetween.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The austenitic stainless steel according to an embodiment the present disclosure may be applied to structural members such as automobiles due to a high yield ratio together with a high yield strength and a high elongation.

The invention claimed is:

1. An austenitic stainless steel having an increased yield ratio comprising, in percent by weight (wt %), 0.1% or less (exclusive of 0) of C, 0.2% or less (exclusive of 0) of N, 1.5 to 2.5% of Si, 6.0 to 10.0% of Mn, 15.0 to 17.0% of Cr, 0.3% or less (exclusive of 0) of Ni, 2.0 to 3.0% of Cu, and the remainder of Fe and other inevitable impurities, and satisfying Expressions (1) and (2) below:

$$3.2 \leq 5.53+1.4Ni-0.16Cr+17.1(C+N)+0.722Mn+1.4Cu-5.59Si \leq 7 \quad \text{Expression (1):}$$

$$551-462(C+N)-9.2Si-8.1Mn-13.7Cr-29(Ni+Cu) \leq 110 \quad \text{Expression (2):}$$

(wherein C, N, Si, Mn, Cr, Ni, and Cu indicate the content (wt %) of respective elements).

2. The austenitic stainless steel according to claim 1, wherein the austenitic stainless steel satisfies Expression (3) below:

$$[4.4+23(C+N)+1.3Si+0.24(Cr+Ni+Cu)+0.1*Mn]+0.16*[((Cr+1.5Si+18)/(Ni+0.52Cu+30(C+N)+0.5Mn+36)+0.262)*161-161] \geq 17 \quad \text{Expression (3):}$$

(wherein C, N, Si, Mn, Cr, Ni, and Cu indicate the content (wt %) of respective elements).

3. The austenitic stainless steel according to claim 1, wherein a yield ratio is 0.6 or more.

4. The austenitic stainless steel according to claim 1, wherein a yield strength is 600 MPa or more.

5. The austenitic stainless steel according to claim 1, wherein an elongation is 35% or more.

6. A method for manufacturing an austenitic stainless steel having an increased yield ratio, the method comprising:

preparing a slab comprising, in percent by weight (wt %), 0.1% or less (exclusive of 0) of C, 0.2% or less (exclusive of 0) of N, 1.5 to 2.5% of Si, 6.0 to 10.0% of Mn, 15.0 to 17.0% of Cr, 0.3% or less (exclusive of 0) of Ni, 2.0 to 3.0% of Cu, and the remainder of Fe and other inevitable impurities, and satisfying Expressions (1) and (2) below;

hot rolling the slab;

hot annealing a hot-rolled steel sheet;

cold rolling the hot-rolled, annealed steel sheet; and cold annealing the cold-rolled steel sheet at a temperature of 1,050° C. or higher:

$$3.2 \leq 5.53+1.4Ni-0.16Cr+17.1(C+N)+0.722Mn+1.4Cu-5.59Si \leq 7 \quad \text{Expression (1):}$$

$$551-462(C+N)-9.2Si-8.1Mn-13.7Cr-29(Ni+Cu) \leq 110 \quad \text{Expression (2):}$$

(wherein C, N, Si, Mn, Cr, Ni, and Cu indicate the content (wt %) of respective elements).

7. The method according to claim 6, wherein the slab satisfies Expression (3) below:

$$[4.4+23(C+N)+1.3Si+0.24(Cr+Ni+Cu)+0.1*Mn]+0.16*[((Cr+1.5Si+18)/(Ni+0.52Cu+30(C+N)+0.5Mn+36)+0.262)*161-161] \geq 17 \quad \text{Expression (3):}$$

(wherein C, N, Si, Mn, Cr, Ni, and Cu indicate the content (wt %) of respective elements).

8. The method according to claim 6, wherein the cold annealing is performed for 10 seconds to 10 minutes.

9. The method according to claim 6, wherein the hot rolling is performed at a temperature of 1,100 to 1,300° C.

10. The method according to claim 6, wherein the hot annealing is performed at a temperature of 1,000 to 1,100° C. for 10 seconds to 10 minutes.

* * * * *